US005115827A

United States Patent [19]

Lee

[11] Patent Number: 5,115,827

[45] Date of Patent: May 26, 1992

[54] UMBRELLA WITH WIND ESCAPE APERTURE

[76] Inventor: Wen P. Lee, 39-12 51st St., Woodside Queens, New York City, N.Y. 11377

[21] Appl. No.: 645,133

[22] Filed: Jan. 24, 1991

Related U.S. Application Data

[63] Continuation-in-part of Ser. No. 557,469, Jul. 25, 1990.

[51] Int. Cl.[5] ..... A45B 25/20

[52] U.S. Cl. ..... 135/33.7

[58] Field of Search ..... 135/35 V, 33.7

[56] References Cited

U.S. PATENT DOCUMENTS 617,415 1/1899 Eatman ..... 135/35 V 1,088,743 3/1914 Swinland ..... 135/35 V

*Primary Examiner*—Henry E. Raduazo

*Attorney, Agent, or Firm*—Robert W. J. Usher

[57] ABSTRACT

A two-tier umbrella has upper and lower series of radially extending ribs supporting upper and lower canopies, respectively. The inner ends of the upper ribs are pivotally connected to the pole and the inner ends of the lower ribs are pivotally connected to respective upper ribs at medial locations while stretchers are pivotally connected at respective opposite ends to a pole slider and to the lower ribs at medial locations thereof.

The upper and lower ribs maintain upper, circular, and lower, annular canopies in dome-shape and spaced apart in imbricating condition with an annular wind escape aperture defined between the overlapping canopy portions.

4 Claims, 1 Drawing Sheet

UMBRELLA WITH WIND ESCAPE APERTURE

RELATED APPLICATION

This is a continuation-in-part of Ser. No. 07/557,469 filed Jul. 25, 1990.

FIELD OF THE INVENTION

The invention relates to umbrellas having wind escape apertures.

BACKGROUND OF THE INVENTION

In spite of the destructive effects and inconvenience caused by backing or side winds having been known for many years, an umbrella that obviates these problems in a reliable, and aesthetically acceptable manner, affording economic mass production manner has not yet been proposed.

As acknowledged in U.S. Pat. No. 4,979,534, although there have been many prior attempts to provide so-called windproof umbrellas with collapsible canopies their wind escape apertures are normally maintained closed by covering flaps movable open the apertures only by the forces associated with an adverse wind. Examples of such prior proposals given therein are U.S. Pat. Nos. 3,032,047; 1,031,974; 3,456,661; FR 817,056; and FR 1,284,022.

Also acknowledged are umbrellas having two canopies for decorative purposes described in U.S. Pat. No. 1,145,768; 1,785,561; 2,746,469.

SUMMARY OF THE INVENTION

It is an object of the invention to provide an umbrella having a collapsible canopy with a wind escape aperture which remains open while the canopy is open, which is both extremely effective, easily erected and reliable in use and yet reasonably economical to manufacture for high volume supply to the mass marketplace.

According to one aspect of the invention there is provided an umbrella having a collapsible frame structure supporting a two-tier canopy and comprising:

a pole having a handle at a lower end and a ferrule adjacent an upper end;

a series of upper, canopy supporting ribs pivotally connected at inner ends to the ferrule to extend radially therefrom:

a series of lower, canopy supporting ribs pivotally connected at lower ends thereof to respective upper ribs at medial locations thereon to extend radially outwardly beyond the upper ribs;

a ferrule runner slidably mounted on the pole;

a series of stretchers pivotally connected at inner ends thereof to the ferrule runner and at outer ends thereof to respective lower ribs at medial locations thereof;

an upper canopy having an outer perimeter affixed at intervals to outer ends of the upper ribs and a lower canopy having an outer perimeter affixed at intervals to outer ends of the lower ribs and an inner perimeter affixed at intervals to the lower ribs at locations thereof spaced apart from the upper ribs;

whereby movement of the ferrule runner up the pole to open the umbrella urges both upper and lower ribs upwardly and outwardly with flexure thereof into a curved configuration bracing the upper and lower canopies in taut, dome-like condition with the inner perimeter of the lower canopy spaced apart from the upper canopy material defining therebetween a continuous, annular, wind escape aperture and the upper and lower canopies in imbricating condition.

Preferably, the inner perimeter of the lower canopy is affixed at intervals to the lower ribs at locations thereof between the pivotal connections of the lower ribs to the upper ribs and to the stretchers, providing a desirable overlap between the canopies.

Preferably, the lower canopy is annular providing a central aperture beneath the upper canopy.

BRIEF DESCRIPTION OF THE DRAWINGS

A specific example of an umbrella according to the invention will know be described with reference to the accompanying drawings in which.

Figure 2:
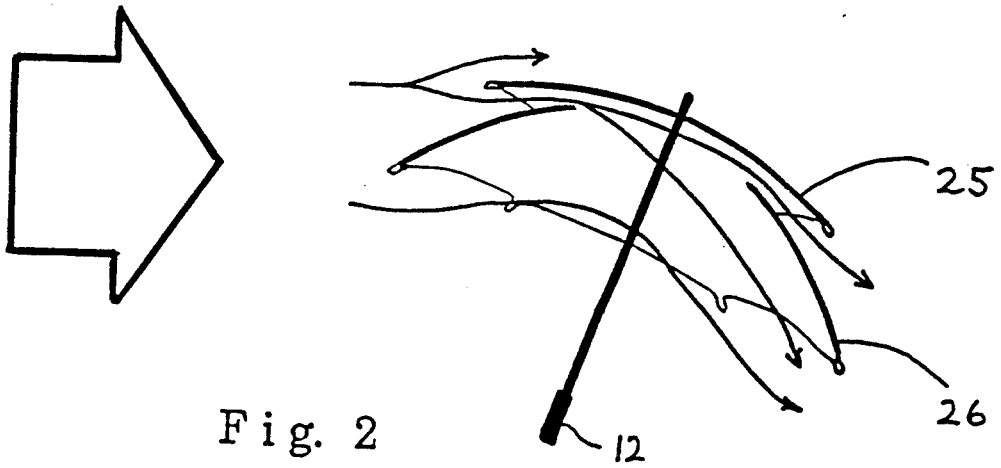
Figure 1:
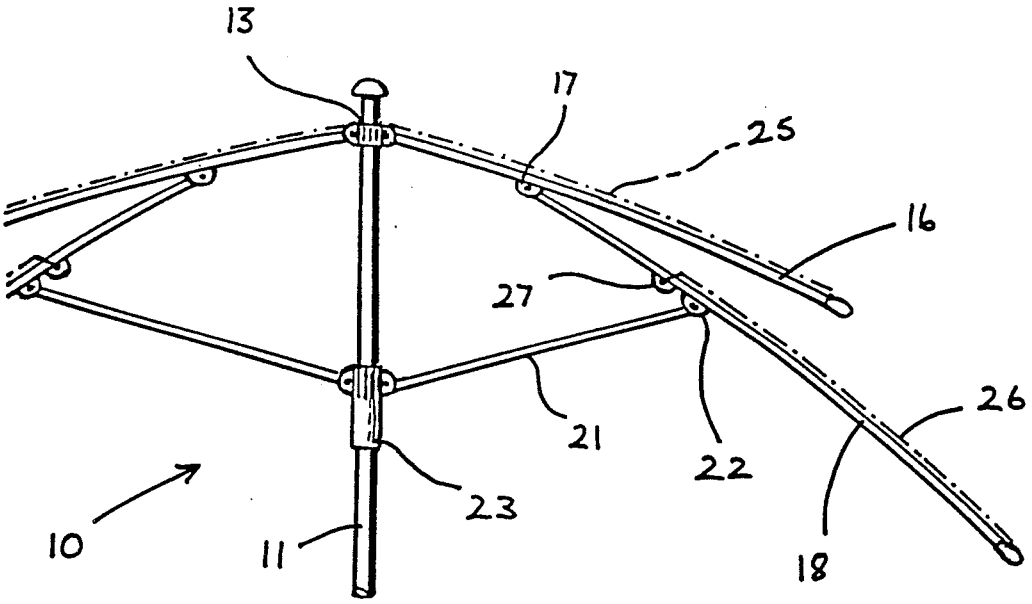
FIG. 1 is an elevational view of part of the umbrella frame in fully erect or open condition; and, FIG. 2 is a schematic showing a possible wind flow through the umbrella.

The umbrella 10 comprises a conventional pole 11 having a handle 12 at a lower end and a ferrule cap 13 adjacent an upper end. A series of upper, canopy supporting ribs 16 have inner ends pivotally connected to the ferrule cap 13 in conventional fashion.

Eye forming lugs 17 with rivets are attached to the upper ribs 16 at medial locations thereof and a series of lower, canopy supporting ribs 18 have inner ends pivotally connected to the respective lugs 17. A series of struts or stretchers 21 have outer ends pivotally connected to eye forming lugs 22 with rivets provided on the lower ribs at locations medially between opposite ends of the ribs but closer to the inner end, and the inner ends of the stretchers are pivotally connected to a ferrule or runner 23 slidably mounted on the pole 11.

A generally circular sheet-form canopy 25 is attached at intervals along an outer perimeter thereof in conventional manner to outer ends of the ribs 16 of the upper series and, at a central location, to the ferrule cap 13.

A lower canopy 26, formed as a continuous, sheet-form annulus has outer and inner perimeters attached in conventional manner at intervals to outer ends of the ribs 18 of the lower series and to eye forming lugs 27, respectively, provided on the lower ribs at locations between the lugs 22 and the lugs 17.

In operation, upward movement of the running ferrule 23 to open the umbrella flexes and braces both series of ribs 16 and 18 of the upper and lower series into curved or arcuate configuration, maintaining the material of the upper and lower canopies braced, spaced apart from each other, in taut, dome-like shape in partially overlapping or imbricating relation thereby defining a continuous annular wind escape aperture between inner perimetrical edge portions of the lower canopy and outer perimetrical edge portions of the upper canopy.

As the stress imposed by each stretcher is distributed between both a respective upper and lower rib, both upper and lower canopies are maintained in taut condition.

The wind escape aperture is extremely effective, particularly as a result both of its location, bisecting the total surface area of the canopy and as a result of its continuity to that deleterious effects of side or backing winds are largely nullified by wind entering the aperture preventing the formation of areas of reduced pressure within the canopy.

Rain driven horizontally against the umbrella does not pass through the aperture as the outer perimeter of the upper canopy extends below the inner perimeter of the lower canopy, while the separation of these perimeters is maintained substantially constant by the ribs of the lower series.

As the separation of the inner perimeter of the lower cavity and the eye forming lug remains constant being determined by the length of the ribs 18 of the lower series, the upper and lower canopies remain tidily overlapped both when the umbrella is fully opened and in fully collapsed or closed condition in which the ribs and canopies extend adjacent the pole with the upper canopy overlapping the lower canopy as well as in all intermediate positions.

I claim:

1. An umbrella having a collapsible frame structure supporting a two-tier canopy and comprising:

a pole having a handle at a lower end and a ferrule adjacent an upper end;

a series of upper, canopy supporting ribs pivotally connected at inner ends to the ferrule to extend radially therefrom:

a series of lower, canopy supporting ribs having free, inner ends pivotally connected directly to respective upper ribs at medial locations thereon to extend radially outwardly beyond the upper ribs;

a ferrule runner slidably mounted on the pole;

a series of stretchers pivotally connected at inner ends thereof to the ferrule runner and at outer ends thereof to respective lower ribs at medial locations thereof;

an upper canopy having an outer perimeter affixed at intervals to outer ends of the upper ribs and a lower canopy having an outer perimeter affixed at intervals to outer ends of the lower ribs and an inner perimeter affixed at intervals to the lower ribs at locations thereof spaced apart from the upper ribs;

whereby movement of the ferrule runner up the pole to open the umbrella urges both upper and lower ribs upwardly and outwardly with flexure thereof into a curved configuration bracing the upper and lower canopies in taut, dome-like condition with the inner perimeter of the lower canopy spaced apart from the upper canopy material defining therebetween a continuous, annular, wind escape aperture and the upper and lower canopies in imbricating condition.

2. An umbrella according to claim 1, wherein the inner perimeter of the lower canopy is affixed at intervals to the lower ribs at locations thereof between the pivotal connections of the lower ribs to the upper ribs and to the stretchers.

3. An umbrella according to claim 1, wherein the lower canopy is annular, providing a circular central aperture beneath the upper canopy.

4. A two-tier umbrella having upper and lower series of radially extending ribs supporting upper, circular and lower, annular canopies, respectively, the upper ribs having inner ends pivotally connected to a pole and the lower ribs having inner, free ends supported entirely by pivotal connection to respective upper ribs at medial locations thereof, stretchers pivotally connected at respective opposite ends to a pole slider and to the lower ribs at medial locations thereof and an inner perimeter of the lower canopy being affixed to the lower ribs at locations between their pivotal connections to the stretchers and to the upper ribs, spaced from the upper ribs so that the upper and lower canopies are maintained in dome-shape and spaced apart in imbricating condition with an annular escape aperture for prevailing winds defined between the overlapping canopy portions.

* * * * *